United States Patent [19]

Lehmann et al.

[11] Patent Number: 4,799,915

[45] Date of Patent: Jan. 24, 1989

[54] RADIO-CONTROLLED ROBOT OPERATOR FOR BATTERY-POWERED TOYS

[76] Inventors: Roger W. Lehmann, 18 Flintlock Ct., Bernardsville, N.J. 07924; Michael I. Satten, 4 Farmers Rd., Kings Port, N.Y. 11024

[21] Appl. No.: 128,628

[22] Filed: Dec. 4, 1987

[51] Int. Cl.[4] ..... A63H 13/00; A63H 17/12; A63H 17/25; A63H 17/39

[52] U.S. Cl. ..... 446/279; 446/353; 446/427; 446/456; 446/460

[58] Field of Search ..... 446/275, 279, 280, 286, 446/456, 484, 427, 424, 2829, 354, 353, 352, 288, 268, 355, 269, 270, 292, 460

[56] References Cited

U.S. PATENT DOCUMENTS

| | | | |
|---|---|---|---|
| 3,546,814 | 12/1970 | Melendez | 446/288 |
| 3,553,885 | 1/1971 | Tazaki | 446/465 X |
| 3,722,136 | 3/1973 | Thorn et al. | 446/354 |
| 4,406,085 | 9/1983 | Rhodes | 446/456 |
| 4,521,204 | 6/1985 | Wiggs et al. | 446/279 X |

OTHER PUBLICATIONS

"Flexi Flier", American Aircraft Modeler, pp. 22–24 and 78–79, Apr. 1974.

*Primary Examiner*—Mickey Yu
*Attorney, Agent, or Firm*—Stoll, Wilkie, Previto & Hoffman

[57] ABSTRACT

A radio-controlled, battery-powered robot operator for interchangeable operation of battery-powered toys. The robot operator performs the operations performed by actual operators of actual vehicles and other machines, e.g., the operation of a gear shift lever and a steering mechanism.

The robot operator is transferable from one battery-powered vehicle to another, and from operating a battery-powered vehicle to operating a battery-powered machine such as a battery-powered hoist mounted on a battery-powered vehicle.

6 Claims, 10 Drawing Sheets

RADIO-CONTROLLED ROBOT OPERATOR FOR BATTERY-POWERED TOYS

BACKGROUND OF THE INVENTION

1. Field of the Invention

This invention relates to radio-controlled robots for controlling battery-powered action toys, especially toy vehicles.

2. Prior Art

The closest prior patent art known to applicant is the following:

U.S. Pat. No. 3,546,814, Melendez
U.S. Pat. No. 3,573,867, Mehrens
U.S. Pat. No. 4,267,663, Nagahara
U.S. Pat. No. 4,290,228, Goldfarb et al.
U.S. Pat. No. 4,493,670, Wang These patents show that the use of a robot operator to operate a vehicle is old art. But what distinguishes the present invention from the prior art patents is its interchangeability feature, that is, the feature that enables the radio-controlled robot operator to be transferred from one battery-powered toy to another, e.g., from one vehicle to another, or from operating a vehicle to operating a machine carried by the vehicle, e.g., a hoist.

In the prior art the robot operator and the vehicle operated by it are integral parts of a single toy. The robot operator is not made or intended to be a separable entity adapted to be transferred to other vehicles or other mechanisms. U.S. Pat. No. 4,290,228 (Goldfarb) is a case in point. The patented invention is applicable to a motorcycle (FIG. 1), an airplane (FIG. 12), a car (FIG. 14) and a boat (FIG. 16), but there is no suggestion that the same robot driver can be used interchangeably in all four vehicles, that is, transferred from any one vehicle to any other vehicle to operate same.

SUMMARY OF THE INVENTION

The feature that enables the robot operator of the present invention to be transferred from one vehicle or machine to another is the mechanical connection between the operating controls of the vehicle or machine. The operating controls of the robot operator are its hands. The operated controls of the vehicle are its steering wheel and its drive control, a simulated gear shift lever or the like. The operated control of a machine (e.g., a hoist) may be a power control lever operated by only one hand. There are no other operating controls between the robot operator and the vehicle or machine.

In all embodiments of the present invention, there are complementary connecting elements or formations on the robot operator's hands and the operated controls of the vehicle and machine. These connecting elements are readily attachable and detachable by a child playing with the toy. The robot operator is itself readily insertable into and removable from the individual vehicles or machines it is intended to operate.

The illusion created by the present toy is that of a simulated operator driving a simulated vehicle in the manner of an actual operator driving an actual vehicle, and the same illusion applies to operating a machine such as a hoist.

DETAILED DESCRIPTION OF PREFERRED EMBODIMENTS

Figure 2:
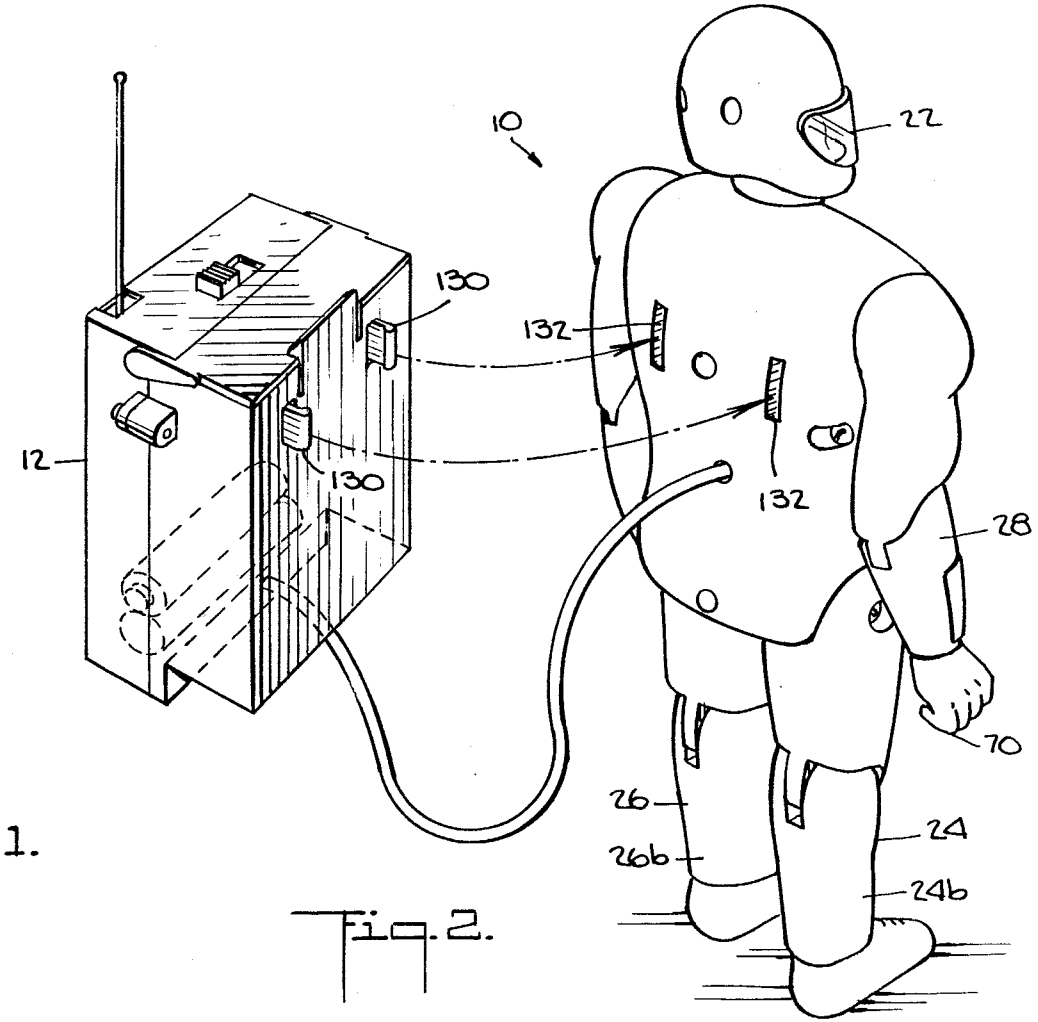
FIG. 2 is a back perspective view of said robot operator showing the backpack removed therefrom.
Figure 1:
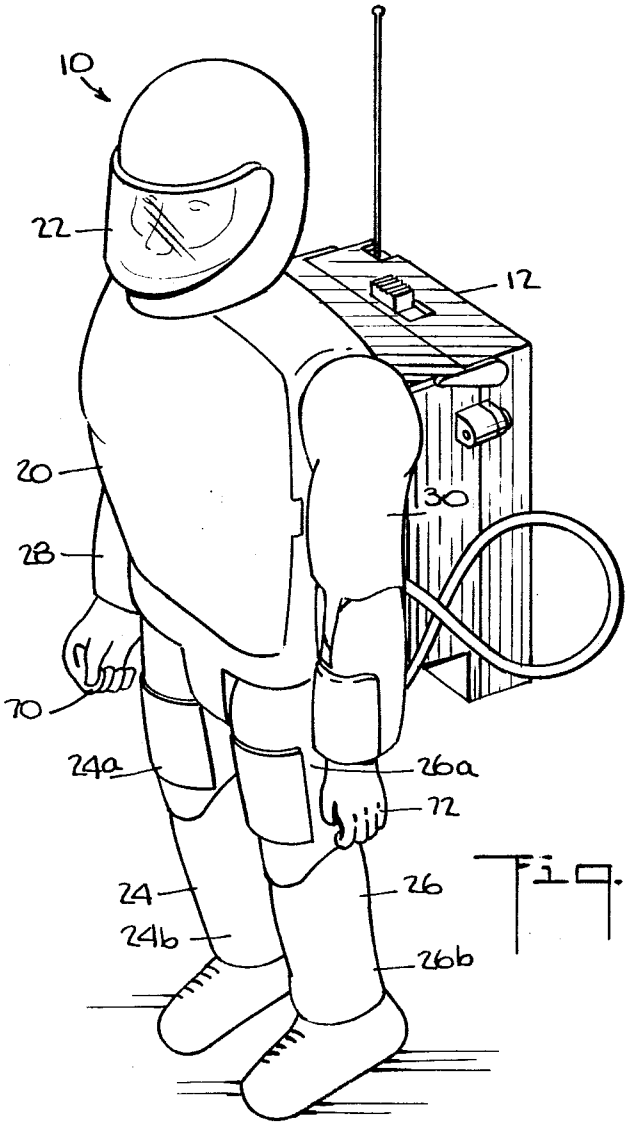
FIG. 1 is a front perspective view of a robot operator carrying a radio-control receiver and power and control backpack as herein described and claimed.
Figure 11:
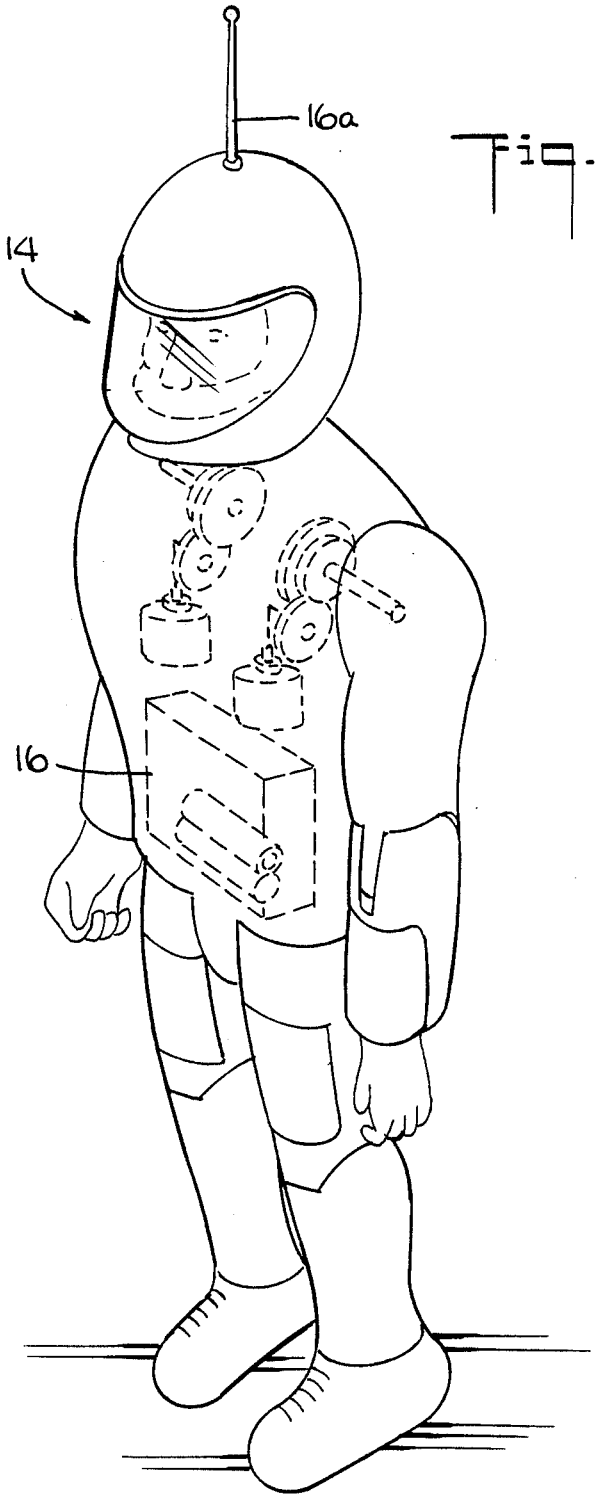
FIG. 11 is a front perspective view of a modified form of the invention, showing the radio-control receiver and power and control elements built into the robot operator itself instead of into a back pack carried by the robot operator.
Figure 12:
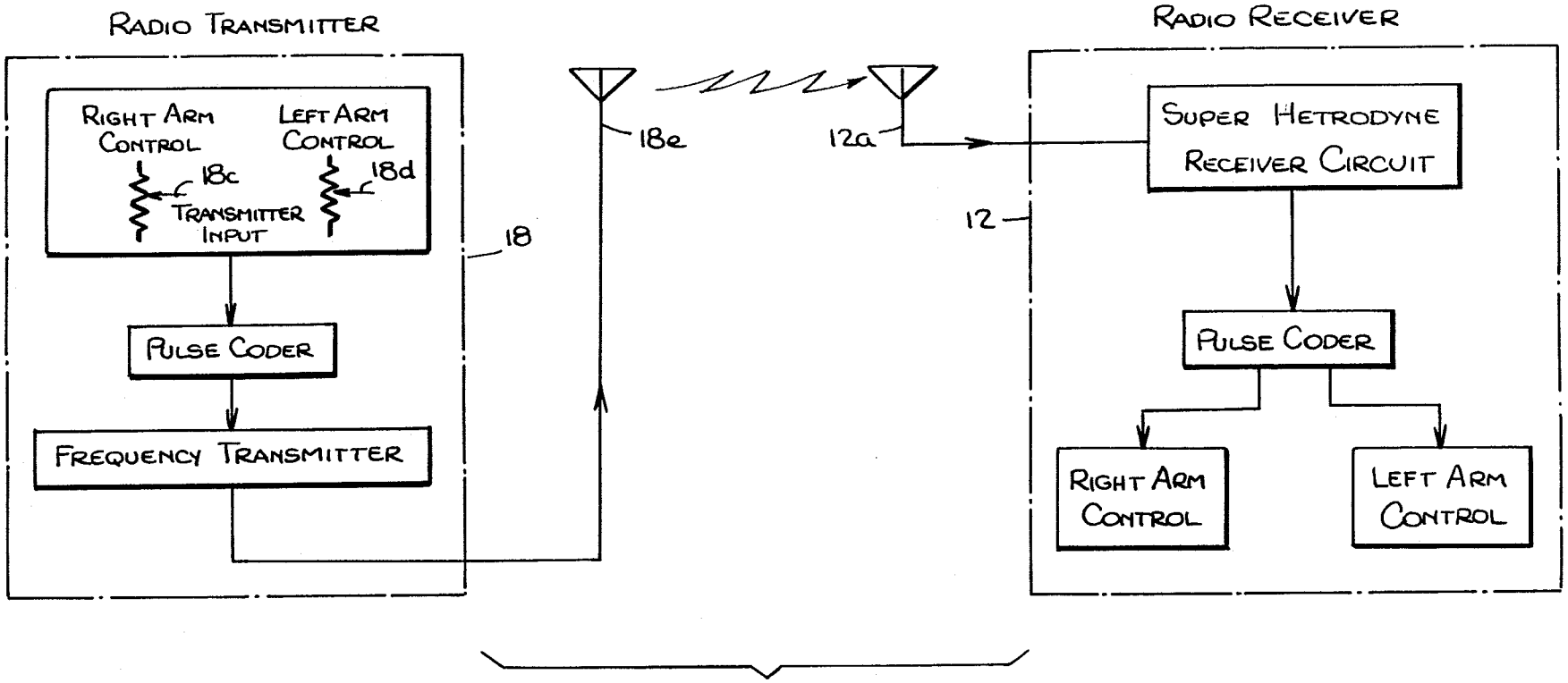
FIG. 12 is a block diagram of the radio transmitting and receiving circuits of the present invention.

The robot operator of the present invention is illustrated in two forms: In FIGS. 1 and 2, robot operator 10 includes an external backpack 12 that comprises a radio receiver and power and control pack. In FIG. 11 robot operator 14 is self-contained in the sense that it contains within itself an internal pack 16 comprising all of the elements—the radio receiver, and the power and control pack—that comprise the backpack 12. In either case, the radio receiver receives signals from a radio transmitter 18 to operate a vehicle V or a machine such as hoist H.

Figure 3:
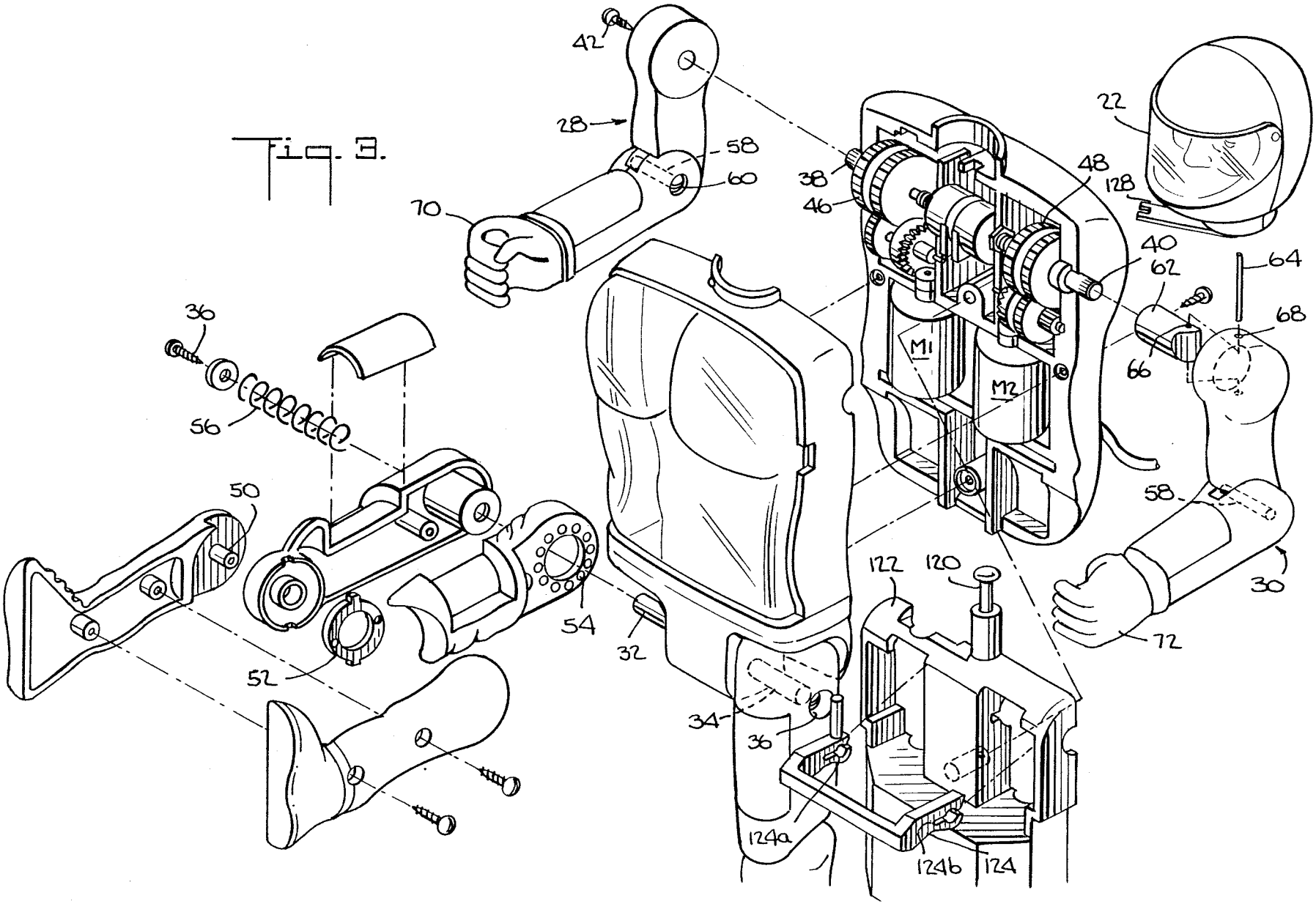
FIG. 3 is a front perspective exploded view of the robot operator showing its mechanical parts.
Figures 4, 4A:
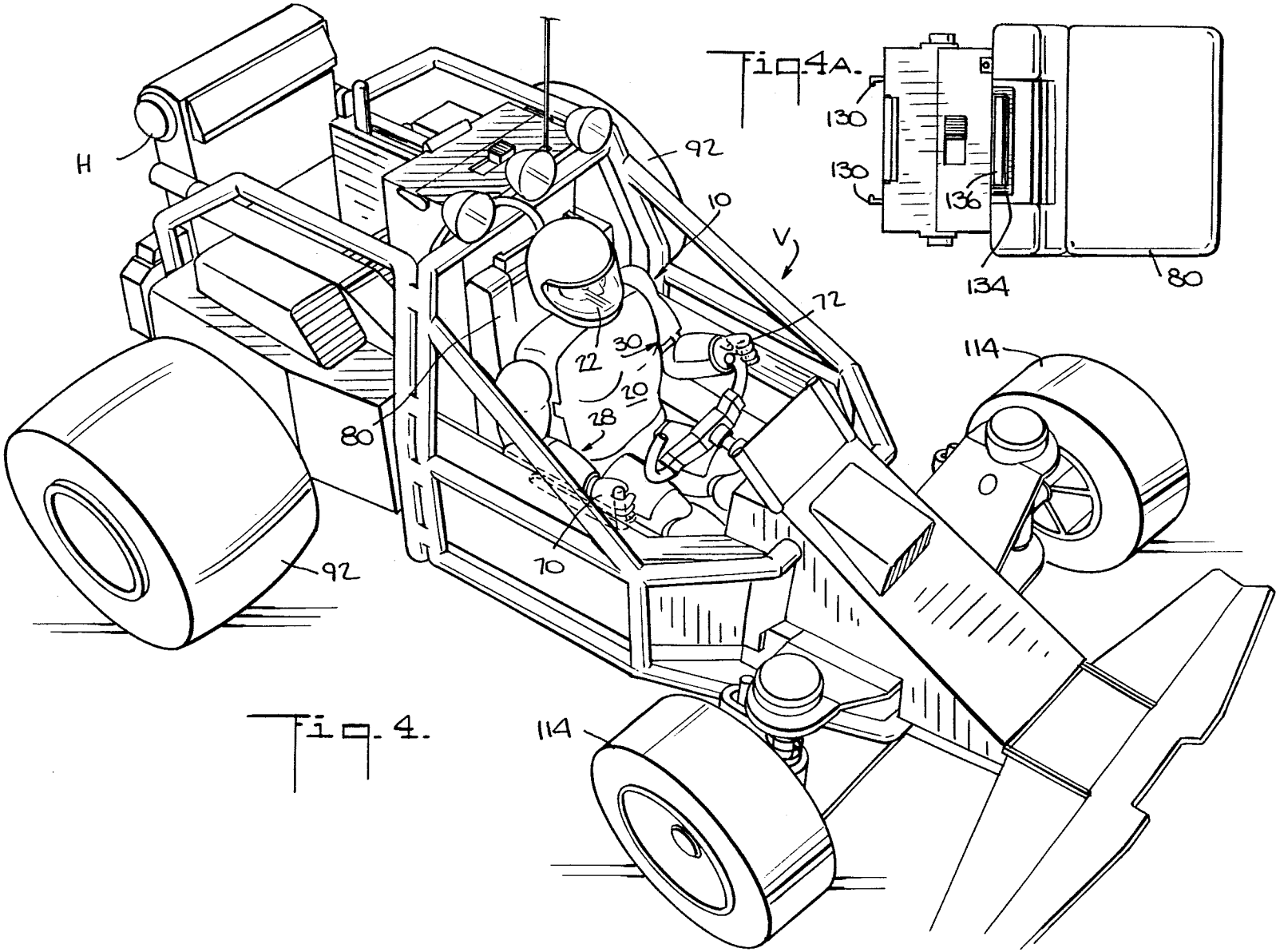
FIG. 4 is a front perspective view of the robot operator in operative position in a vehicle adapted to be operated by it.

Turning now to FIGS. 1–3, it will be seen that robot operator 10 has a hollow torso 20, a head 22, including a helmet, a pair of legs 24, 26 supporting the torso, and a pair of arms 28, 30 attached to the torso. The legs are pivotally attached to the torso by means of aligned crosspins 32, 34 and screws 36. The arms are attached to the torso by means of aligned shafts 38, 40 and screws 42. These shafts are connected, respectively, to gear drives 46, 48 shortly to be described. Cross-pins 32, 34 and shafts 38, 40 extend along parallel axes.

It will be observed that legs 24, 26 are articulated at the knee. Specifically, upper legs **24*a*, 26*a* are joined to lower legs 24*b*, 26*b* by means of cross-pin 50. Thus, crosspins 32, 34 enable legs 24, 26 to pivot relative to the torso, while cross-pin 50 enables the upper and lower legs to pivot relative to each other. The legs are thereby enabled to assume standing or sitting positions. To hold the legs in selected positions, detents 52 and complementary dimples 54 are formed between the torso and each upper leg and between the upper and lower legs. Compression spring 56** applies spring pressure between the detents and dimples of the torso and upper legs to hold the legs in their selected positions under spring pressure.

Arms 28, 30 are articulated at the elbow, thus, upper arm 28*a* is joined to lower arm 28*b*, and upper arm 30*a* is joined to lower arm 30*b*, by means of pins 58 and screws 60. Within a sufficient angular range, the upper and lower arms are freely movable relative to each other about the axes of pins 58. These axes are parallel to the axis of shafts 38, 40 on which the arms are mounted.

It will be noted that one of the arms, in the illustrated robot operator, left arm 30, is enabled to swivel on an axis perpendicular to the axis of the shaft (shaft 40) on which it is mounted. As shown in FIG. 3, arm 30 is attached to shaft 40 by means of a sleeve 62 that is pressfitted on or otherwise secured to the shaft. A locking pin 64, fixed in hole 66 in sleeve 62 and rotatable in holes 68 in the shoulder of arm 30, enables arm 30 to swivel relative to the axis of shaft 40.

An important feature of right hand 70 and left hand 72 of the robot operator is the means that enables them to engage and operate gear shift lever 74 and steering wheel 76 respectively. Thus, the fingers of the right hand 70 are curled around to form, with the palm, an annular keeper for the gear shift lever 74. The fingers of the left hand are also curled but only to enable the left hand to engage the steering wheel. To resist accidental dislodgment of the left hand from the steering wheel, a knob 76*a* is formed on the steering wheel and a keeper 72*a* therefor is formed in the left hand. Keeper 72*a* may take the form of a socket or hole formed in the palm of the left hand. Knob 76*a* may be split to provide a spring action that enables the knob to snap into the socket.

Figure 6:
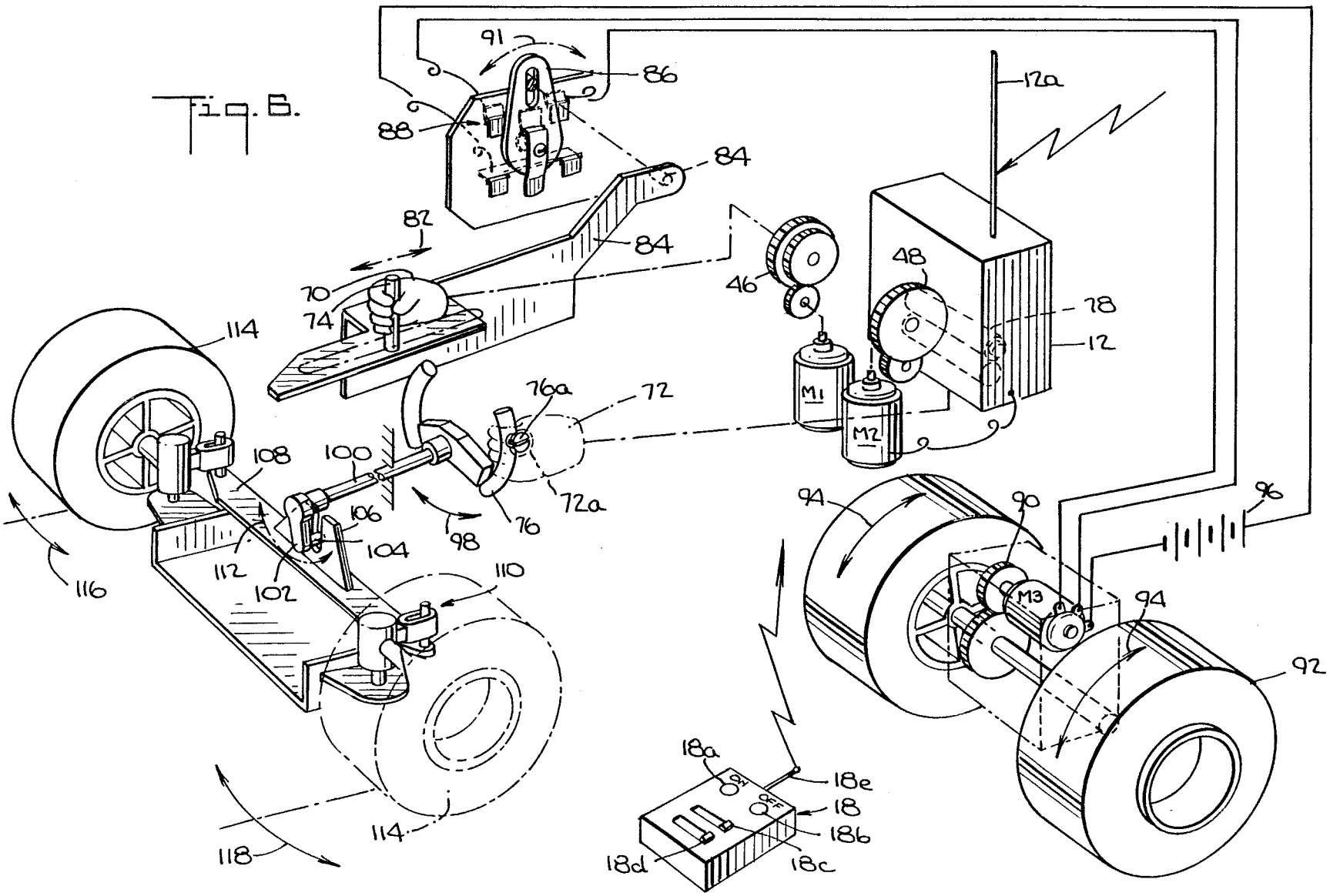
FIG. 6 is a fragmentary front perspective exploded view of said vehicle showing its electrical operating parts, showing also the electrical and mechanical controls of the robot operator and its power and control pack, and the radiocontrol signal transmitter.
Figures 9, 10:
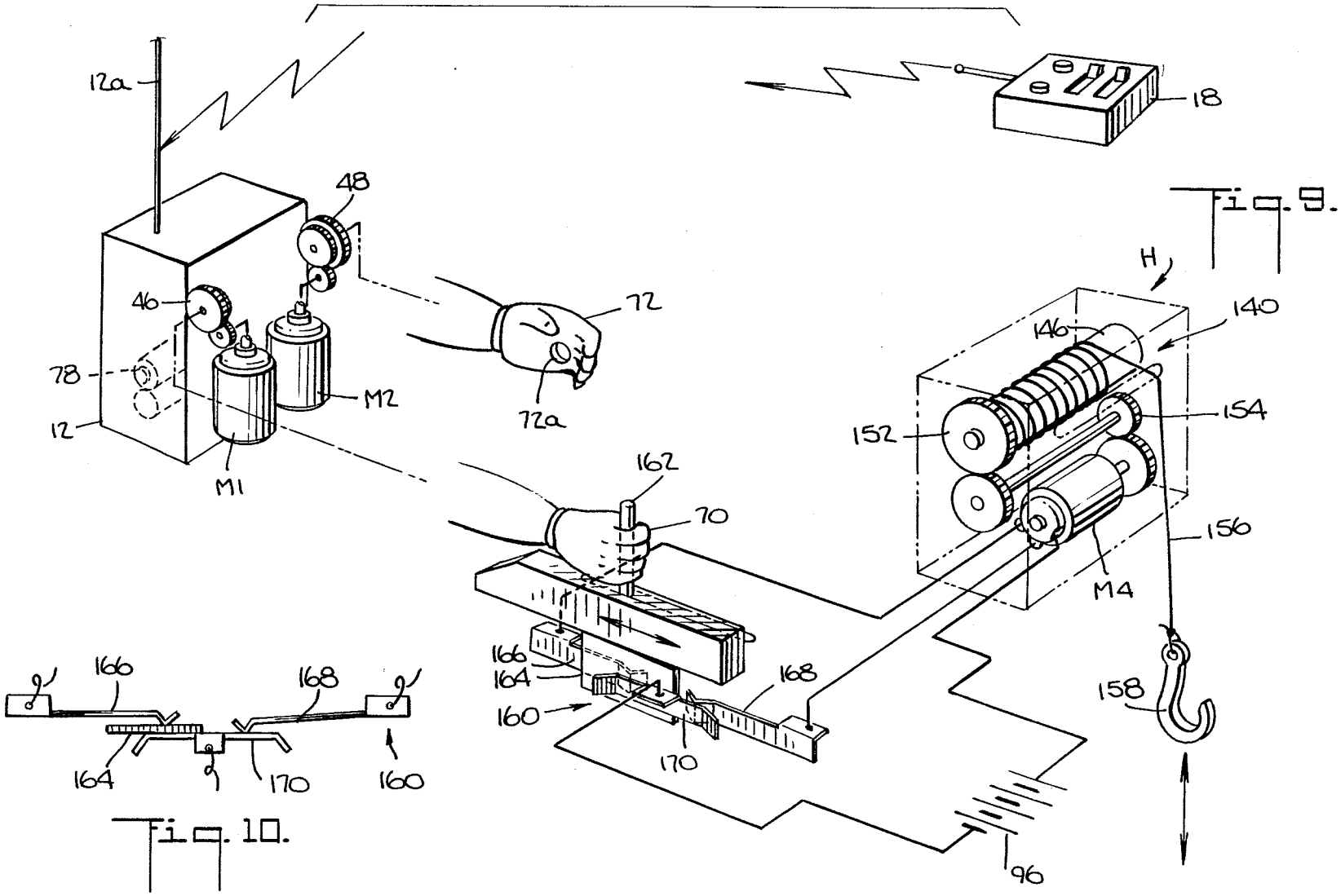
FIG. 9 is a perspective exploded view of the hoist showing its mechanical and electrical parts and the mechanical and electrical parts of the robot operator that operate the hoist, showing also the radio-control signal transmitter.
FIG. 10 is a detail of the switch that controls that operation of the hoist.

Gear drives 46 and 48 are conventional speed reducing gear drives operated, respectively, by motors M1 and M2 powered by batteries 78 in the backpack 12. These motors are reversible by reversing polarity. FIGS. 6 and 10 show how these gear drives operate the arms of the robot operator and, through them, the gear shift lever and steering wheel.

For the operation and control of the gear shift lever 74 and the steering wheel 76, it is necessary to refer to the radio-control transmitter 18. Two push buttons 18*a* and 18*b*, marked ON and OFF respectively, operate a conventional power supply switch. Two slide buttons (or dials or the like) 18*c* and 18*d* operate the radio transmitter to send radio signals through antenna 18*e* to antenna 12*a* of the radio receiver of backpack 12. The radio receiver 16 of the modified robot operator 14 (FIG. 11) receives signals from the radio transmitter 18 through antenna 16*a*.

The signals generated by the operation of slide button 18*c* control motor M1 which operates gear drive 46 and this, in turn, operates the right arm of the robot operator. When the robot operator sits in the front seat 80 with its right hand holding the gear shift lever 74, the gear drive 46 will cause that hand to move forwardly or rearwardly, depending on the polarity of motor M1. This will cause the gear shift lever to move in the same forward or rearward direction. See arrow 82 in FIG. 6.

The gear shift lever 74 is attached to a slideable bracket 84 carrying a pin 84. This pin actuates a pivotally mounted switch arm 86 of switch 88 that controls motor M3. This motor, operating through a differential gear drive 90, drives rear wheels 92 on shaft 93 of vehicle V. Motor M3 is reversible by reversing its polarity. Polarity is reversed by actuation of slide button 18*c* on the radio transmitter. This causes the robot operator's right hand to change the direction of its movement as indicated by arrow 82. This causes a corresponding change of direction of movement of gear shift lever 74 and switch arm 86 as indicated by arrow 91. Arrows 94 indicate the directions of rotation of rear vehicle wheels 92 as polarity of the motor is reversed. Power to motor M3 is supplied by batteries 96 carried by the vehicle and shown in the circuit diagram of FIG. 6.

When motor M2 is energized by actuation of slide button 18*d*, it causes the left arm of the robot operator to move in one direction or the other about the axis of shaft 40 and about the axis of pin 64. This motion of the left arm causes the left hand to turn the steering wheel in one direction or the other as indicated by arrow 98 in FIG. 6.

A shaft 100 connects the steering wheel 76 to a radial arm 102 having a pin 104 at its outer end. Pin 104 engages a yoke 106 on the tie rod 108 of the conventional steering gear 110 of the vehicle. Consequently, when the robot operator turns the steering wheel in one direction or the other (arrow 98) it causes the radial arm to turn in corresponding directions as indicated by arrow 112, and, through a conventional pitman action, this results in the front wheels 114 of the vehicle steering in corresponding directions. See arrows 116, 118 of FIG. 6.

The robot operator is provided with still another action to simulate the action of an actual driver of an actual vehicle. Reference is here made to the turning movement of the robot operator's head 22 when the vehicle is caused to steer in either direction. Head 22 is rotatably mounted on pin 120 extending from a frame 122 secured within the torso 20 of the robot operator. A bracket 124 is supported within the torso by means of clamp elements 124*a*, 124*b* that engage shafts 38, 40 respectfully. Clamp element 124*a* engages shaft 38 loosely while clamp element 124*b* engages shaft 40 tightly. Consequently, when shaft 40 is caused to rotate in either direction, bracket 124 rotates with it in the same directions.

It will now be observed that projecting from bracket 124 is a pin 126 that engages a bifurcated member 128 secured to the head of the robot operator. Consequently, when shaft 40 is caused to rotate in either direction to operate the left arm and thereby to steer the vehicle, the head of the robot operator is caused to rotate about the axis of pin 120 in the same direction. This means that when the vehicle is steered to the left, the head turns to the left, and when it is steered to the right, the head turns to the right, thereby simulating the turning of an actual driver's head in the direction of steering.

It will, of course, be understood that any suitable means for attaching the backpack 12 to the back of the robot operator may be used. In the preferred embodiment of the invention, the backpack is attached to the robot operator by means of a pair of detents 130 on one side of the backpack that snap into slots 132 formed in the back of the robot operator's torso. But the backpack is removed from the robot operator when the latter is placed in the vehicle seat 80 in order to drive the vehicle. Any suitable means may then be used to hold the backpack on the vehicle, for example, a keeper 134 that is formed on the opposite side of the backpack and is engageable with a tongue 136 formed on the backrest of seat 80.

Figure 7:
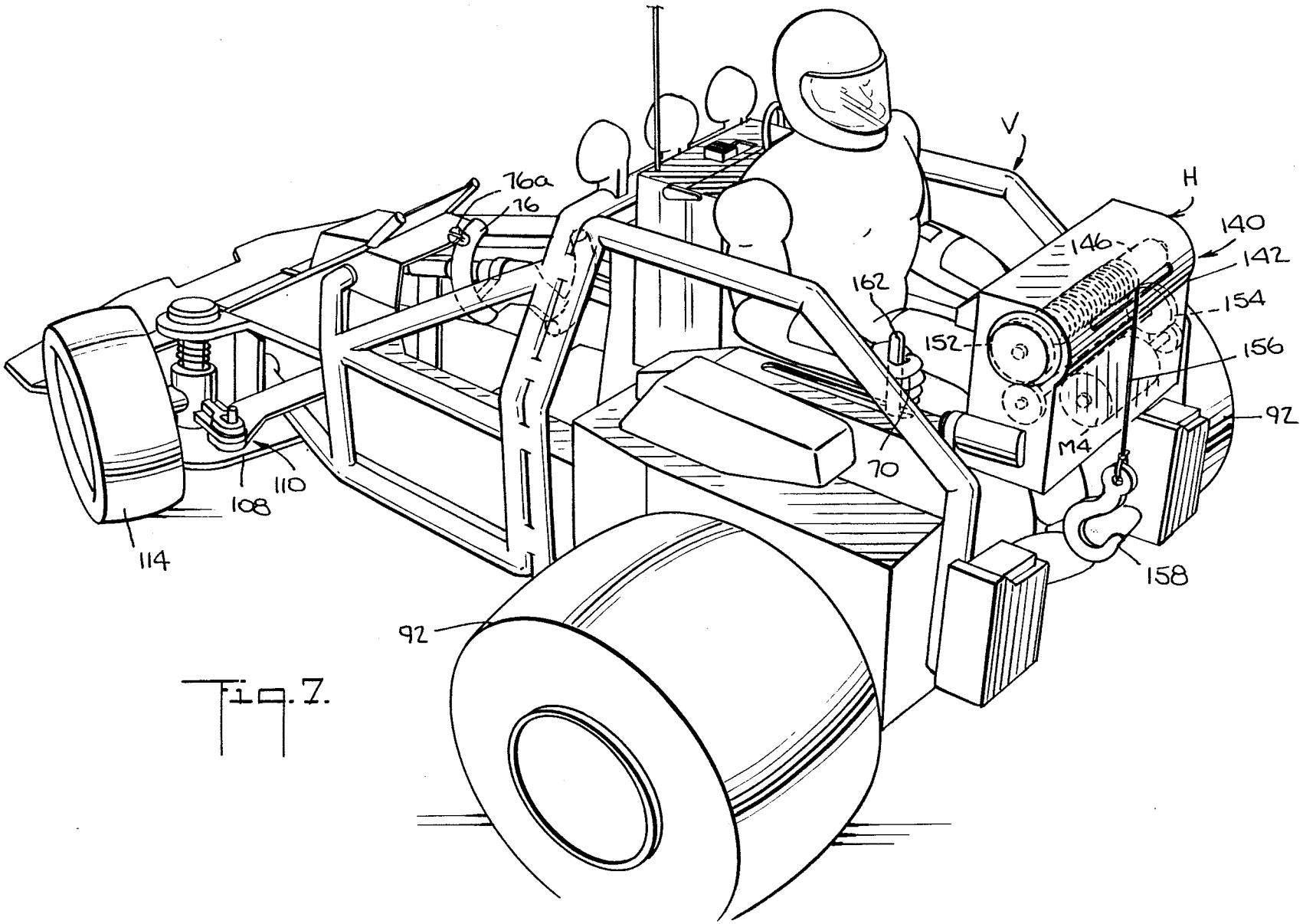
FIG. 7 is a front perspective view of the robot operator and a back perspective view of the vehicle, showing the robot operator in operating position relative to a hoist mounted on the vehicle.

The robot operator may also be used to operate hoist H. This requires that the robot operator be placed in the rear seat of the vehicle, but the backpack remains supported on tongue 136. In this arrangement, the robot operator rests against the backpack, detents 130 of the backpack engaging slots 132 in the robot operator, to hold the robot operator in sitting position in order to operate the hoist. See FIG. 7.

Figure 8:
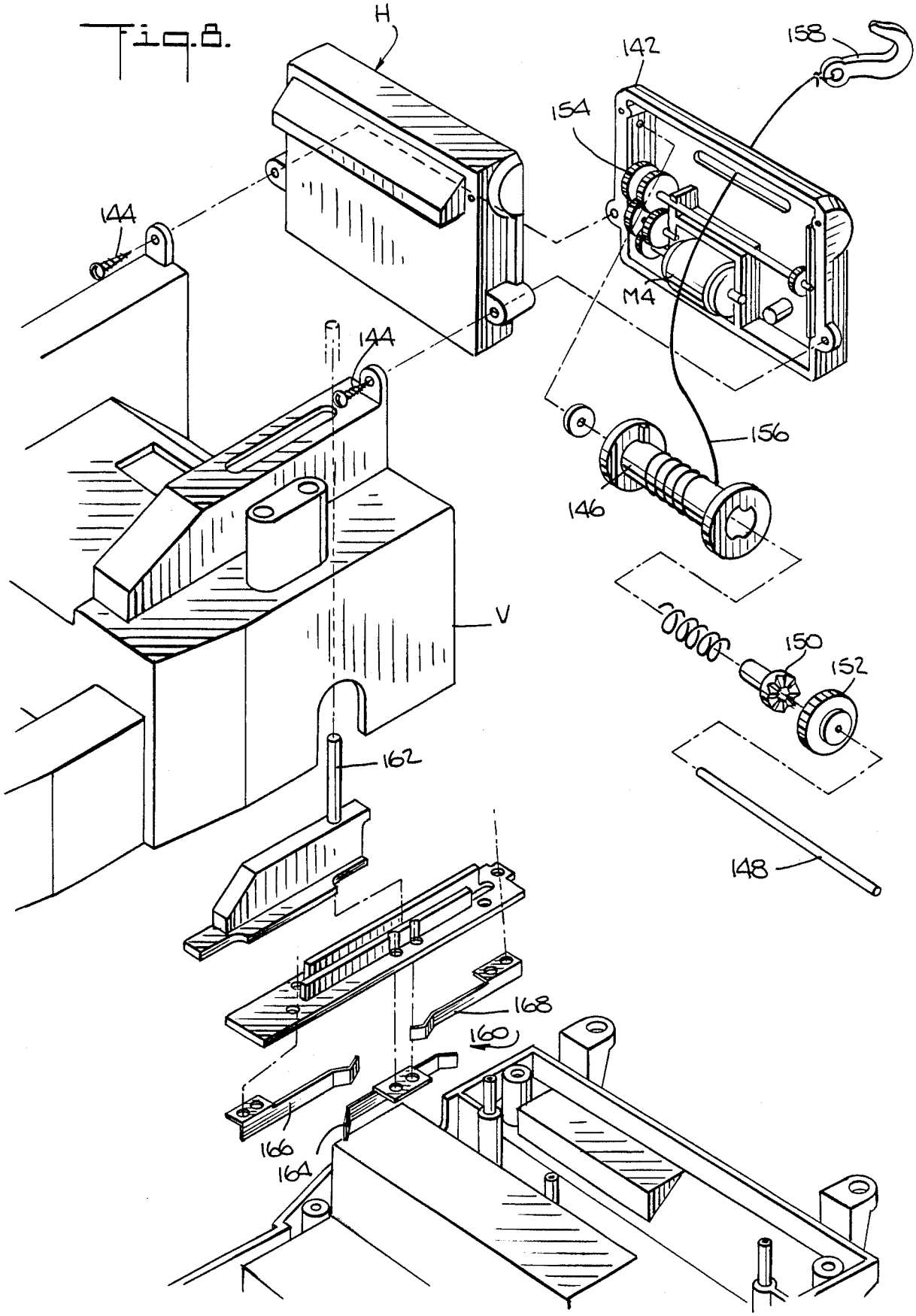
FIG. 8 is a perspective exploded view of the hoist and the rear part of the vehicle on which the hoist is mounted.

Hoist H comprises a motor-powered winch 140 mounted in an enclosure 142. As shown in FIG. 8, the enclosure is secured to the rear of the vehicle V by means of screws 144 or any other conventional means. The winch comprises a drum 146 mounted on a shaft 148 and a spring-urged clutch 150 connects the drum to a gear wheel 152. A motor M4 drives gear wheel 152 through a gear train 154. A string 156 is wound on drum 146 and it carries a hook 158 that may be used to hoist an object.

As shown in FIG. 10, the winch motor M4 is in circuit with batteries 96 of the vehicle and switch 160. This switch is operated by means of a control handle 162 that is connected to a non-conductive slide 164. This slide is movable between leaf contacts 166, 168 and stationary contact 170. The slide is movable to disengage either or both leaf contacts from the stationary contact. In the latter slide position the switch is open and the hoist motor is inoperative. In the former slide position, depending on which leaf contact is disengaged, the motor operates to rotate the winch in one direction or the other. As shown in FIG. 10, the right hand of the robot operator operates control handle 162 in the same manner as it operates gear shift lever 74.

Figure 5:
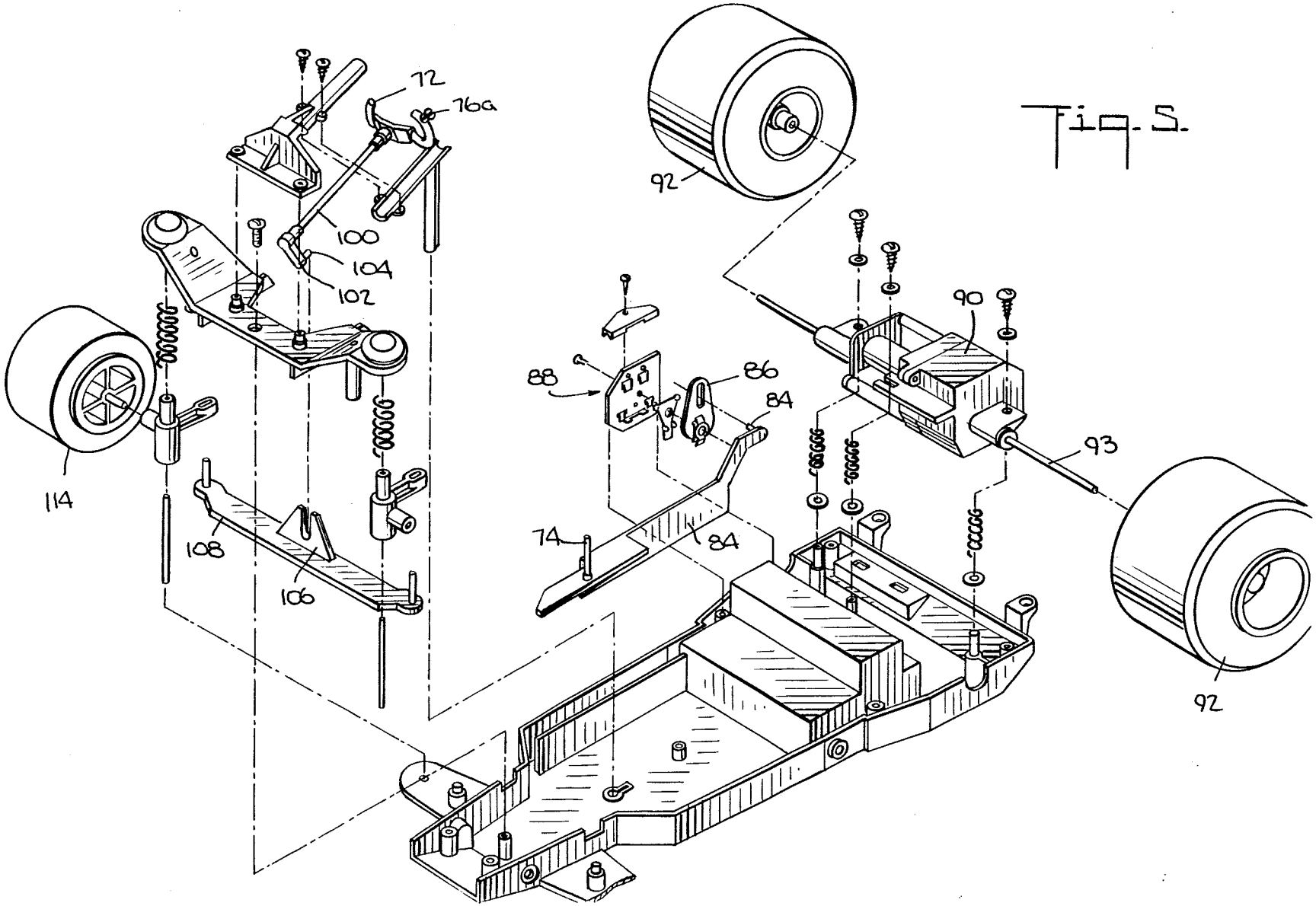
FIG. 5 is a front perspective exploded view of said vehicle showing its mechanical parts.

The foregoing description is specific to the form of the invention shown in the drawing, but it will be understood that other forms are equally intended to be encompassed within the claims. For example, the design of the vehicle as shown in FIGS. 5 and 6 is intended to illustrate the various designs to which the present invention can be applied. Whether the vehicle simulates a drag racer (as shown) or any other kind of vehicle is immaterial to the invention. Similarly, any suitable mechanical means enabling the robot operator's hands to hold and operate the gear shift lever and steering wheel may be substituted for the specific means shown in the drawing.

What is claimed is:

1. In combination, a battery-powered, radio-controlled robot and a battery-powered action toy having multiple action control means controlled by said robot, comprising:

a. a robot having movable arms, including hands, and battery-powered motor drive means for individually actuating said arms, b. a power and control pack electrically connected to said motor drive means, and having means for removably attaching said power and control pack on said robot, c. said power and control rack comprising battery-powered, radio-controlled control means for controlling said motor drive means of the robot and thereby individually actuating said arms, d. said hands having engaging means for individually engaging the multiple action control means of said action toy, e. whereby said radio-controlled control means is adapted to control the multiple action control means of the action toy by individually actuating the arms of the robot.

2. The combination of claim 1 wherein the action toy is a vehicle having two individually operable action control means, one a drive control means, and the other a steering control means, a. the hand of one of the robot's arms being the engaging means for engaging the drive control means, b. whereby said radio-controlled control means is adapted to control said drive control means, c. the hand of the other of the robot's arms being the engaging means for engaging the steering control means, d. whereby said radio-controlled control means is adapted to control said steering control means.

3. The combination of claim 2, wherein:

a. each individual arm drive means comprises a motor-driven gear train driving a shaft, b. each motor-driven gear train being individually powered and controlled by the radio-controlled control means, c. each shaft extending transversely of the robot at one of its shoulders and in alignment with the other shaft, d. each arm of the robot being mounted on one of said shafts for angular movement therewith when it is driven by its motor-driven gear train.

4. The combination of claim 3, wherein:

a. each arm comprises an upper arm member and a lower arm member and a pivotal connection between said upper and lower arm members at the elbow, b. the pivotal axis of said pivotal connection being parallel to the axis of the shaft on which the arm is mounted.

5. The combination of claim 1, wherein:

the power and control pack comprises a backpack.

6. The combination of claim 5, wherein:

a. the backpack is provided with additional mounting means for mounting said backpack on the action toy having action control means, b. said additional mounting means being detachable for removing the backpack from said action toy, c. whereby said backpack may be replaced on said action toy or mounted on another action toy having action control means.

* * * * *